US007556164B2

(12) United States Patent
Tanaka et al.

(10) Patent No.: US 7,556,164 B2
(45) Date of Patent: Jul. 7, 2009

(54) SYNTHETIC RESIN THIN-WALLED BOTTLE CONTAINER WITH BOTTOM HEEL

(75) Inventors: Noriyuki Tanaka, Koto-ku (JP); Takao Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 698 days.

(21) Appl. No.: 10/501,789

(22) PCT Filed: Jan. 29, 2003

(86) PCT No.: PCT/JP03/00854

§ 371 (c)(1),
(2), (4) Date: Dec. 20, 2004

(87) PCT Pub. No.: WO03/064269

PCT Pub. Date: Aug. 7, 2003

(65) Prior Publication Data

US 2005/0082250 A1 Apr. 21, 2005

(30) Foreign Application Priority Data

Jan. 31, 2002 (JP) ..... 2002-022868

(51) Int. Cl.
*B65D 23/00* (2006.01)
*B65D 23/10* (2006.01)
*B65D 1/02* (2006.01)
*B65D 1/46* (2006.01)

(52) U.S. Cl. ..... 215/373; 215/371; 215/382; 215/384; 220/606; 220/608; 220/609; 220/675; 220/771

(58) Field of Classification Search ..... 215/371, 215/373, 374, 382, 384; 220/606, 609, 608, 220/669, 675, 771
See application file for complete search history.

(56) References Cited

U.S. PATENT DOCUMENTS 3,366,290 A * 1/1968 Mojonnier et al. ..... 222/572
3,409,167 A * 11/1968 Blanchard ..... 220/609
3,973,693 A * 8/1976 Brocklehurst ..... 220/604
4,372,455 A * 2/1983 Cochran ..... 215/385

(Continued)

FOREIGN PATENT DOCUMENTS

DE 69 20 207 U 1/1970

(Continued)

*Primary Examiner*—Sue A Weaver
(74) *Attorney, Agent, or Firm*—Oliff & Berridge, PLC

(57) ABSTRACT

The present invention provides synthetic resin thin-walled bottle container (10, 20, 30) including a mouth portion (11) for filling or discharging contents, a body portion (12, 22, 32) extending from the mouth portion (11) along the center axis (A) of the container, and a heel portion ($H_{10}$, $H_{20}$, $H_{30}$) provided at the bottom part (13, 23, 33) of the body portion (12, 22, 32) for placing, thereon, the body portion (12, 22, 32) in a self-supporting manner. The heel portion ($H_{10}$, $H_{20}$, $H_{30}$, $H_{40}$) includes a sidewall (14, 24, 34) formed of a curved surface ($R_{11}$, $R_{21}$, $R_{31}$) that is recessed toward the inside of the container (10). Thus, even with a reduced amount of the resin, the container (10, 20, 30) can be stably self-supported without causing inclination or buckling at the heel portion ($H_{10}$, $H_{20}$, $H_{30}$), under a load applied in the center axis (A) direction thereof.

8 Claims, 6 Drawing Sheets

U.S. PATENT DOCUMENTS

| | | | | | |
|---|---|---|---|---|---|
| 4,880,129 | A | * | 11/1989 | McHenry et al. | 220/609 |
| 6,068,161 | A | * | 5/2000 | Soehnlen et al. | 222/143 |
| 6,349,838 | B1 | * | 2/2002 | Saito et al. | 215/371 |
| 6,752,284 | B1 | | 6/2004 | Akiyama et al. | |

FOREIGN PATENT DOCUMENTS

| | | | |
|---|---|---|---|
| DE | 30 00 785 | A1 | 7/1980 |
| EP | 1 099 638 | A1 | 5/2001 |
| FR | 2 759 976 | A1 | 8/1998 |
| JP | A 56-48946 | | 5/1981 |
| JP | A 07-149336 | | 6/1995 |
| JP | A 10-139029 | | 5/1998 |
| JP | A 10-258824 | | 9/1998 |

* cited by examiner (Related Art)

SYNTHETIC RESIN THIN-WALLED BOTTLE CONTAINER WITH BOTTOM HEEL

BACKGROUND ART

1. Technical Field

The present invention relates to a synthetic resin thin-walled bottle container comprising a mouth portion for filling or discharging contents, a body portion extending from the mouth portion, and a heel portion provided at a bottom part of the body portion, for placing the body portion thereon in a self-supporting manner.

2. Related Art

Synthetic resin thin-walled bottle containers are thinner than ordinary bottle containers and are thus capable of achieving light-weighted containers and reduction in the volume of wastes. As such, this sort of synthetic resin containers are used as refill containers for detergents for kitchen use, bathroom use and the like.

Meanwhile, the thin-walled bottle containers are sometimes used as they stand, and are thus provided with an annular heel portion near a bottom surface of the container's body portion so as to cause the container itself to self-support on a supporting surface such as shelf or table. Further, the heel portion comprises a sidewall having a curved surface bulged toward the outside of the container relative to said sidewall, a flat and annular bottom face region continuous to the sidewall, and a bottom-up region continuous to the bottom face region and inwardly recessed toward the vicinity of a bottle's center axis.

This sort of thin-walled bottle containers are stretch blow molded from a thermoplastic synthetic resin such as polypropylene (PP), so that the molded article (bottle container) has a non-uniform wall thickness, thereby failing to completely eliminate occurrence of so-called "thickness deviation". Therefore, when it is contemplated to further reduce the resin amount in a conventional thin-walled bottle container in view of environmental problems, the bottle container in a contents-filled state may cause inclination and/or buckling at a thin-walled region of the heel portion where the thickness-deviation has occurred, under a load applied in a center axis direction of the container.

DISCLOSURE OF THE INVENTION

It is therefore an object to be achieved by the present invention, to provide a synthetic resin thin-walled bottle container which, when filled with contents, can be stably self-supported without causing inclination or buckling under a load applied in the center axis direction of the container, while allowing reduction of the resin amount.

To achieve such an object, the present invention provides a synthetic resin thin-walled bottle container comprising a mouth portion for filling or discharging contents, a body portion extending from the mouth portion, and a heel portion provided at a bottom part of the body portion for placing, thereon, the body portion in a self-supporting manner, wherein the heel portion comprises a sidewall having a curved surface recessed toward the inside of the container.

According to the present invention, the heel portion of the synthetic resin thin-walled bottle container comprises the sidewall formed of the curved surface recessed toward the inside of the container in a so-called "reverse R" manner. The sidewall constituted in such reverse R manner produces an increased restoring force even when the container is applied with a load in the center axis direction, for example. It is therefore possible to provide a synthetic resin thin-walled bottle container which, even when filled with contents, can be more stably self-supported without causing inclination or buckling under a load applied in the center axis direction, while allowing reduction of the resin amount.

It is preferred that the heel portion further comprises a bottom face region formed of a curved surface continuous to the sidewall and bulged toward the outside of the bottle container relative to said sidewall, a bottom-up region inwardly recessed toward the vicinity of the bottle center axis, and a rising region for smoothly connecting the bottom face region and the bottom-up region to each other. In this instance, the bottom face region and the rising region are bulged toward the underside of the bottle container when it is filled with the contents due to the thin-walled nature of the bottle container. However, when such a container is placed on a supporting surface, these bulged portions are brought to form a flat surface to be closely contacted with the supporting surface. It is thus possible to further improve the stability of the bottle container when the same is self-supported.

BEST MODE FOR CARRYING OUT THE INVENTION

Some preferred embodiments of the present invention will be more fully described below with reference to the accompanying drawings.

Figure 1:
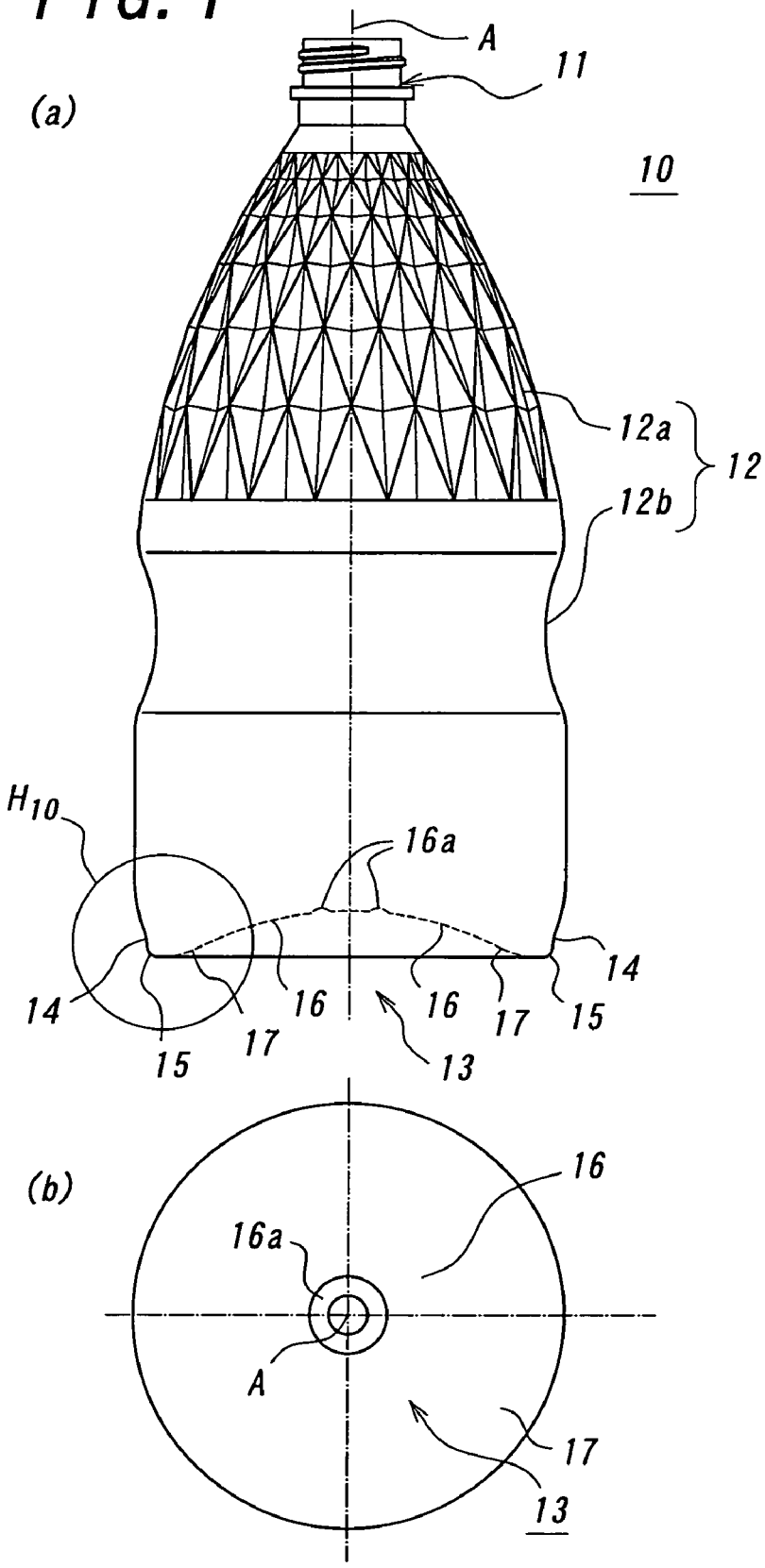
FIGS. 1(*a*) and 1(*b*) are a side view and a bottom view, respectively, showing a bottle container according to a first embodiment of the present invention.

FIGS. 1(*a*) and 1(*b*) are a side view and a bottom view, respectively, showing a bottle container 10 according to a first embodiment of the present invention.

The bottle container 10 is a thin-walled one, having a volume of 560 cc and obtained by stretch blow molding a PP (polypropylene) resin in an amount of 6 g, and comprises, as shown in FIG. 1(*a*), a mouth portion 11 for filling or discharging contents, a body portion 12 extending from the mouth portion 11 along a center axis A of the container 10, and a heel portion $H_{10}$ provided at a bottom part 13 of the body portion 12 so as to cause the container 10 to be self-supported on a supporting surface.

More specifically, for example, the mouth portion 11 has a structure, onto and from which a screw cap (not shown) can be fitted and detached. In this instance, the cap to be fitted onto the mouth portion 11 is not limited to the screw cap, and there may be alternatively used existing ones such as a hinge-type cap or irremovable virgin cap. Further, the body portion 12 has a sidewall provided with a reinforcing portion 12*a* in a diamond-cut pattern at a shoulder portion of the body portion adjacent to the mouth portion 11, and a gripping recess 12*b* for enhancing the gripping force to be applied by users.

Figure 2:
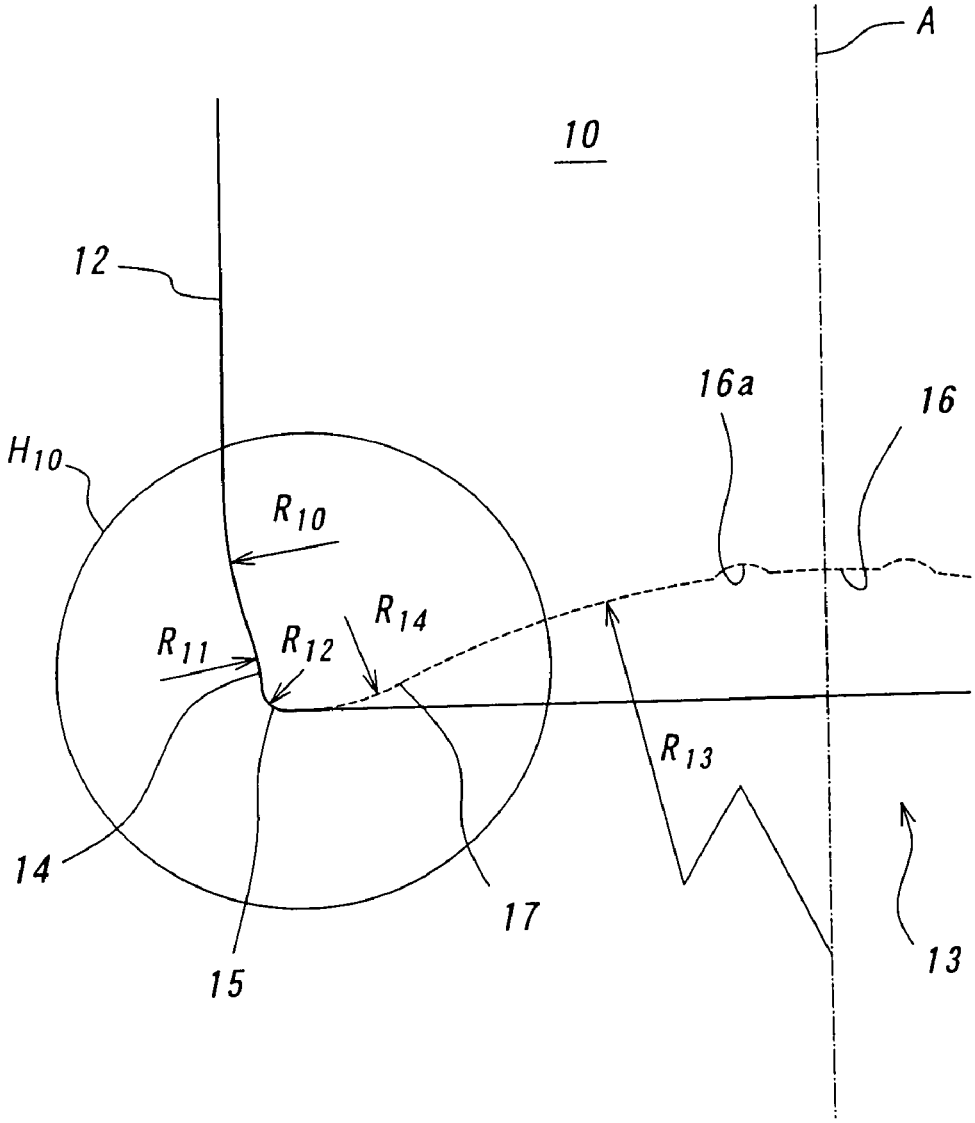
FIG. 2 is an enlarged side view of a bottom part of the container of the first embodiment.

FIG. 2 is an enlarged view showing the bottom part 13 of the bottle container 10 in enlarged scale. As shown in FIG. 2, the heel portion H10 comprises, in an annular manner around the bottle axis A, a sidewall 14 formed of a curved surface recessed toward the inside of the bottle container 10, a bottom face region 15 formed of a curved surface continuous to the sidewall 14 and bulged toward the outside of the bottle container 10 relative to said sidewall 14, a bottom-up region 16 represented by a broken line and inwardly recessed toward the vicinity of the center axis A, and a rising region 17 for continuously connecting the bottom face region 15 and the bottom-up region 16 to each other.

By way of example, the sidewall 14 at the heel portion $H_{10}$ is constituted of a curved surface having a radius of curvature $R_{11}$ and connected to the sidewall of the body portion 12 through a curved surface having a radius of curvature $R_{10}$. The bottom face region 15 is constituted of a curved surface having a radius of curvature $R_{12}$ and continuous to the sidewall 14. Further, the bottom-up region 16 is constituted of a curved surface having a radius of curvature $R_{13}$, and provided with an annular groove 16*a* around the center axis A, the annular groove having been formed by holding an end of a preform so as to avoid an axis deviation thereof upon stretching the preform. The bottom face region 15 and the bottom-up region 16 are connected to each other through the rising region 17 having a larger radius of curvature, i.e., constituted of a curved surface having a radius of curvature $R_{14}$ and smoothly continued along a tangential line of the bottom face region 15.

Since such a bottle container is molded by stretch blow molding a thermoplastic resin such as polypropylene (PP), as described above, it is practically impossible to completely eliminate thickness deviation at those parts constituting the angled faces such as the heel portion. Therefore, when the resin amount of the thin-walled bottle container is reduced, and such container as being internally filled with contents is to be self-supported, the container tend to give rise to inclination and/or buckling at the thin-walled region of the heel portion where a thickness-deviation has occurred.

Since, however, the heel portion $H_{10}$ of the thin-walled bottle container 10 according to the present embodiment comprises the sidewall 14 formed of the curved surface that is recessed toward the inside of the container 10 (in a so-called "reverse R" manner), the sidewall 14 constituted in such reverse R manner has an increased restoring force even when the side surface of the container 10 is applied with a lateral load, for example. It is thus possible, according to the present embodiment, to provide a synthetic resin thin-walled bottle container, which can be more stably self-supported even when filled with contents, without causing inclination or buckling, while allowing reduction of the resin amount.

According to the present embodiment, in particular, the heel portion H10 comprises the bottom face region 15 formed of the curved surface continuous to the sidewall 14 and bulged toward the outside of the bottle container 10 relative to said sidewall 14, the bottom-up region 16 inwardly recessed toward the vicinity of the bottle center axis A, and the rising region 17 for continuously connecting the bottom face region 15 and bottom-up region 16 to each other. The bottom face region 15 and rising region 17 are bulged toward the underside of the container 10 when it is filled with the contents, due to the thin-walled nature of the container 10. However, when the container is placed on the supporting surface such as shelf or table, these bulged portions are brought to form a flat surface to be closely contacted with the supporting surface, thereby further improving the stability of the container 10 when the same is self-supported.

Figure 3:
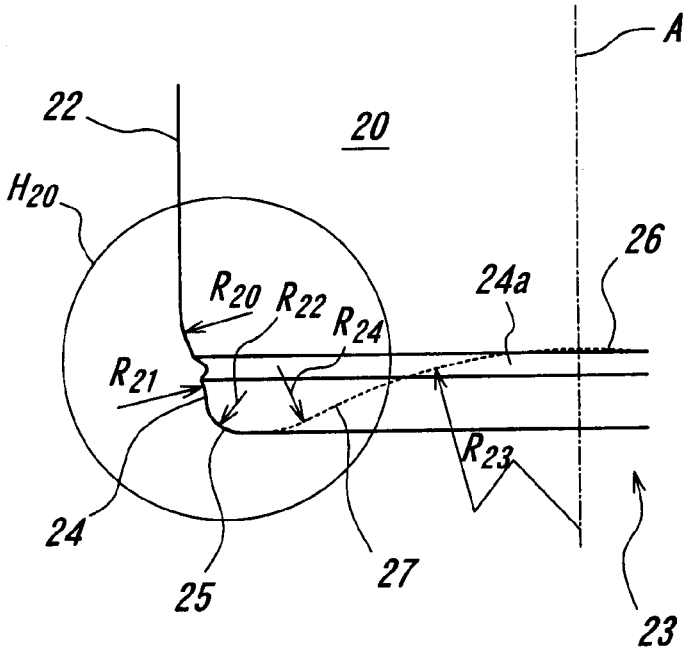
FIG. 3 is an enlarged view showing the relevant parts in a second embodiment of the present invention.
Figure 4:
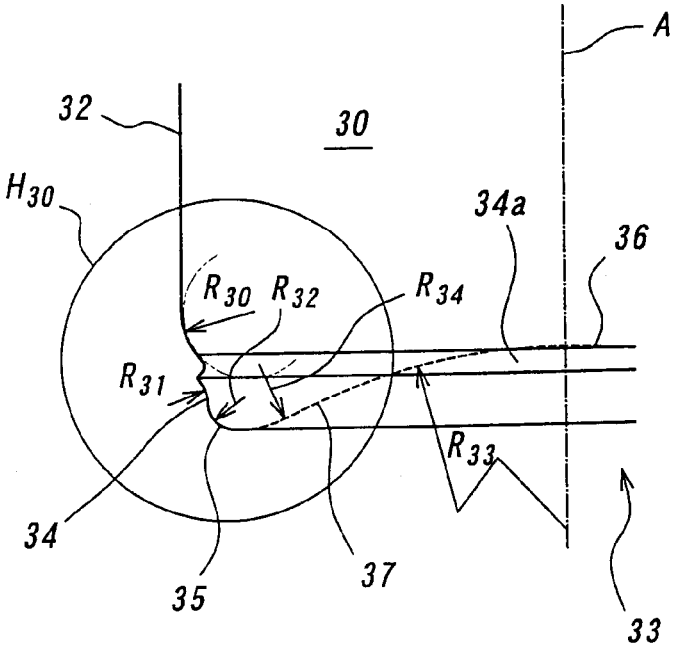
FIG. 4 is an enlarged view showing the relevant parts in a third embodiment of the present invention.

FIG. 3 and FIG. 4 are enlarged views showing the relevant parts in a second embodiment and a third embodiment of the present invention, respectively.

The thin-walled bottle container 20 according to the second embodiment includes, as shown in FIG. 3, a heel portion $H_{20}$ connected to a body portion 22 and comprises, in an annular manner around the center axis A, a sidewall 24 formed of a curved surface having a radius of curvature $R_{21}$ so as to be recessed toward the inside of the container 20 and connected to the sidewall of the body portion 22 through a curved surface having a radius of curvature $R_{20}$, a bottom face region 25 formed of a curved surface having a radius of curvature $R_{22}$ so as to be continuous to the sidewall 24 and bulged toward the outside of the container 20, a bottom-up region 26 represented by a broken line and formed to have a radius of curvature $R_{23}$ so as to be inwardly recessed toward the vicinity of the center axis A of the container, and a substantially planar rising region 27 having a radius of curvature $R_{24}$ for continuously connecting the bottom face region 25 and bottom-up region 26 to each other. This embodiment is basically the same as the first embodiment, but is different therefrom in that the sidewall 24 is formed with an annular groove 24*a* around the bottle axis A.

Similarly, the thin-walled bottle container 30 according to the third embodiment shown in FIG. 4 includes a heel portion $H_{30}$ connected to a body portion 32 and comprises, in an annular manner around the center axis A, a sidewall 34 formed of a curved surface constituted to have a radius of curvature $R_{31}$ so as to be recessed toward the inside of the container 30 and connected to the sidewall of the body portion 32 through a curved surface having a radius of curvature $R_{30}$, a bottom face region 35 formed of a curved surface having a radius of curvature $R_{32}$ so as to be continuous to this sidewall 34 and bulged toward the outside of the container 30, a bottom-up region 36 represented by a broken line and constituted to have a radius of curvature $R_{33}$ so as to be inwardly recessed toward the vicinity of the center axis A, and a substantially planar rising region 37 having a radius of curvature $R_{34}$ for continuously connecting the bottom face region 35 and bottom-up region 36 to each other. This embodiment, too, is basically the same as the first embodiment, but is different therefrom in that the radius of curvature $R_{31}$ defining the sidewall 34 provided at the heel portion $H_{30}$ is set to be smaller than the radius of curvature $R_{11}$ of the sidewall 14 in the first embodiment, thereby providing a curved surface exhibiting a stronger recession.

Figure 5:
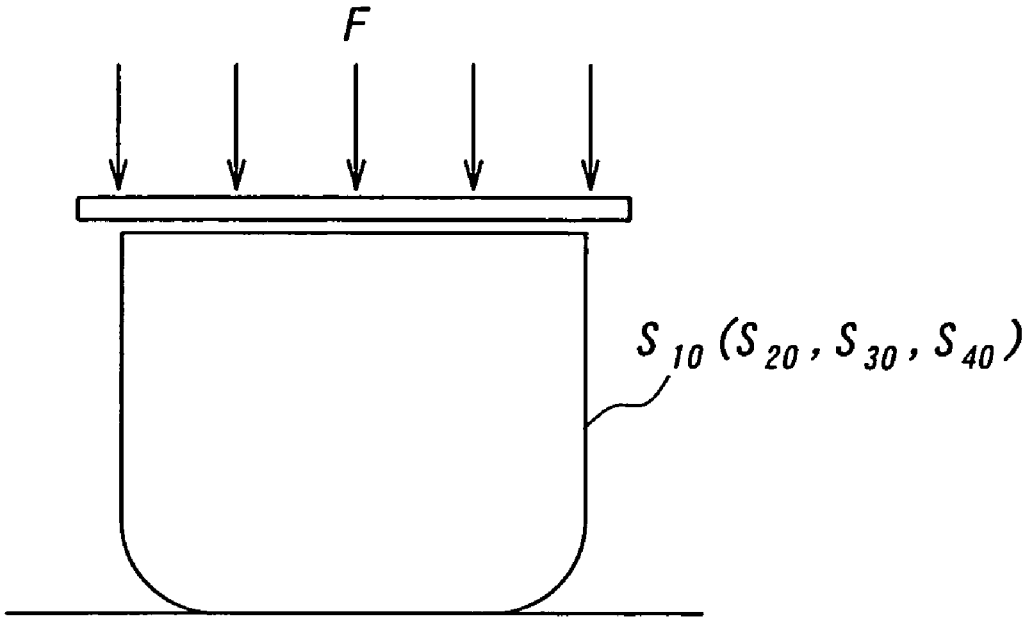
FIG. 5 is a conceptional view showing the testing method for testing a buckling strength of the thin-walled bottle containers according to the first through third embodiments, respectively, and a thin-walled bottle container of a comparative example.
Figure 6:
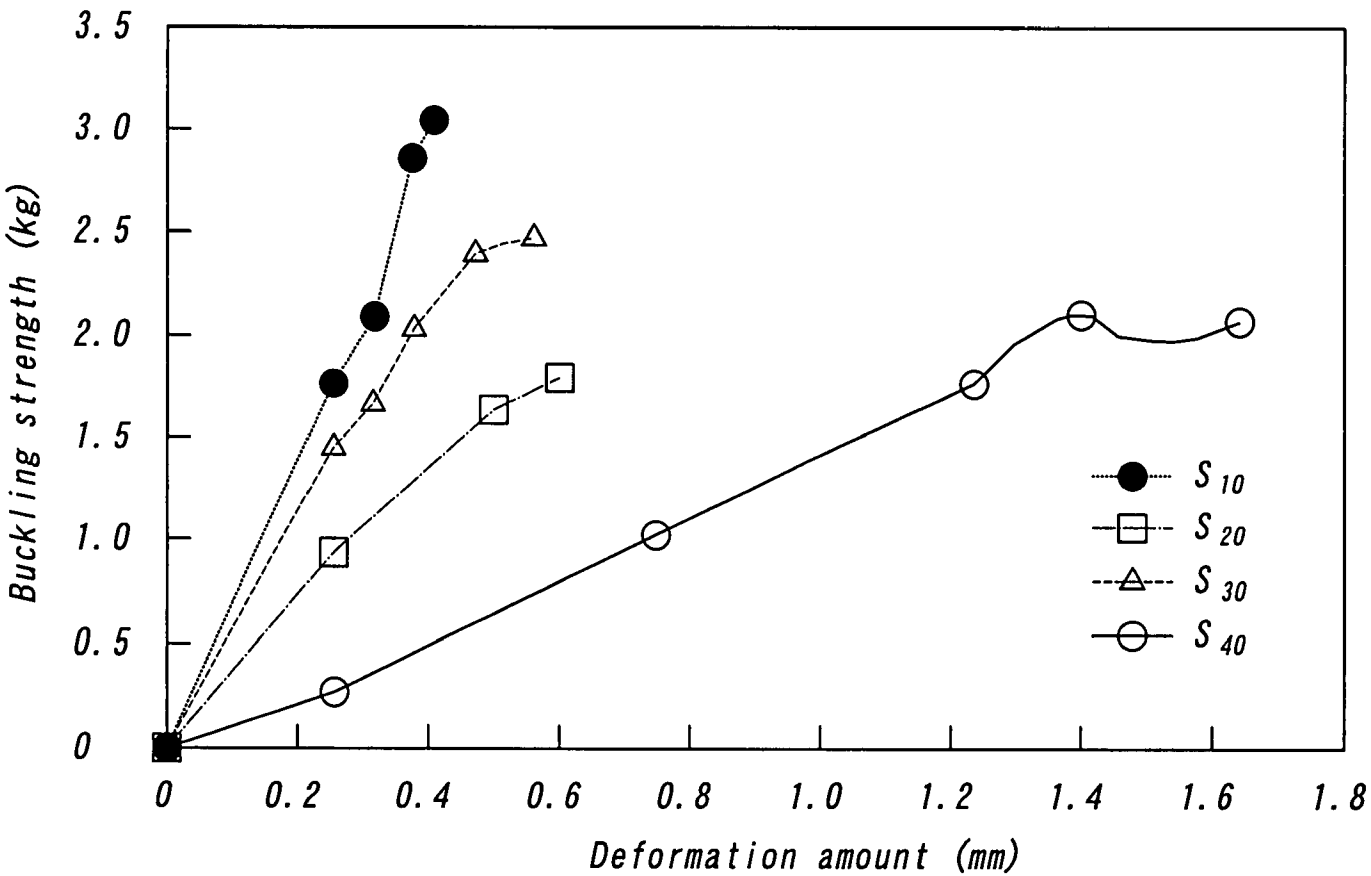
FIG. 6 is a graph illustrating the test results in respect of the buckling strengths of the thin-walled bottle containers according to the first through third embodiments, respectively, and the thin-walled bottle container of the comparative example.

FIG. 5 and FIG. 6 are a conceptional view of a buckling strength testing method and a graph illustrating test results thereof, respectively, in respect of the above described thin-walled bottle containers 10 through 30 according to the first through third embodiments, respectively, and a conventional thin-walled bottle container 40 (comparative example).

Figure 7:
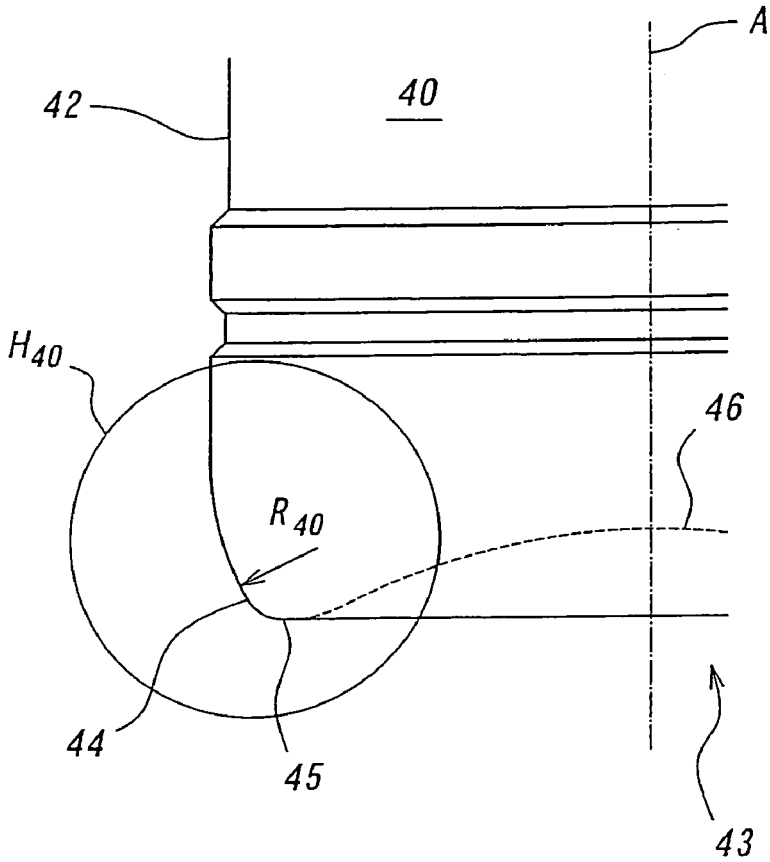
FIG. 7 is an enlarged showing the relevant parts in the thin-walled bottle container according to a comparative example.

As shown in FIG. 7, the thin-walled bottle container 40 according to the comparative example includes an annular heel portion $H_{40}$ arranged near a bottom surface 43 of a body portion 42 and comprises a sidewall 44 having a curved surface (of radius of curvature $R_{40}$) bulged toward the outside of the bottle container 40, a flat and annular bottom face region 45 continuous to the sidewall 44, and a bottom-up region 46 continuous to the bottom face region 45 and inwardly recessed toward the vicinity of the bottle center axis A.

With reference to FIG. 5, in order to perform the buckling strength test, there have been produced cup-like test pieces $S_{10}$, $S_{20}$, $S_{30}$, $S_{40}$ by preparing the bottle containers 10 through 40, each having the heel portion $H_{10}$, $H_{20}$, $H_{30}$, $H_{40}$ with a thickness deviation of 10%, and horizontally cutting the body portions of the containers. Then, a pressure plate is placed onto the cut edge of each of the test pieces $S_{10}$, $S_{20}$, $S_{30}$, $S_{40}$ so as to apply a compressive load F in the center axis direction until buckling occurs, while measuring a lateral deformation extent at the bottom part of each test piece upon buckling. Needless to say, the containers 10 through 40 for preparing the test pieces $S_{10}$, $S_{20}$, $S_{30}$, $S_{40}$ have essentially the same wall thickness and dimensions, except for the configurations of the heel portions $H_{10}$, $H_{20}$, $H_{30}$, $H_{40}$, respectively.

The test results are illustrated in FIG. 6 as a graph wherein the abscissa represents the lateral deformation extent (mm) at the bottom part of the relevant test piece, and the ordinate represents the buckling strength (kg) thereof under the compressive load F, with respect to the following test pieces:

Test piece $S_{10}$: container 10 of the first embodiment,

Test piece $S_{20}$: container 20 of the second embodiment,

Test piece $S_{30}$: container 30 of the third embodiment, and

Test piece $S_{40}$: container 40 of the comparative example.

As can be appreciated from FIG. 6, the test pieces $S_{10}$, $S_{20}$, $S_{30}$ prepared from the thin-walled bottle containers 10 through 30 according to the present invention exhibit lateral displacement extents which are reduced down to as less as about 20% of that exhibited by the test piece $S_{40}$ prepared from the conventional thin-walled bottle container 40. Thus, the thin-walled bottle containers 10 through 30 according to the present invention, when filled with the contents, can be effectively restored to the erected positions, respectively, without causing inclination or buckling under the load in the center axis direction.

Although the present invention has been described above with reference to the illustrated preferred embodiments, it is apparent that various modifications may be made without departing from the scope of the appended claims. For example, the amount of the resin constituting the thin-walled bottle container is not limited to 6 g for the container volume of 560 ml, and may be variously modified to 9 g through 11 g equivalently to typical thin-walled bottle containers. It is also possible to appropriately modify the volume of the bottle container to 350 ml, 500 ml, 1,000 ml, 2,000 ml or the like, as required. Furthermore, the shape of the bottle body portion may be a typical one without reinforcing portion 12*a* and gripping recess 12*b* such as those provided in the first embodiment.

The invention claimed is:

1. A synthetic resin thin-walled bottle container comprising:

a mouth portion for filling or discharging contents;

a body portion extending from the mouth portion; and a heel portion provided at a bottom part of the body portion, for placing therein the body portion in a self-supporting manner, the heel portion comprising:

a sidewall having a curved surface that is recessed toward the inside of the container;

a bottom face region formed of a curved surface that is smoothly continuous with the curved surface of the sidewall and bulged toward the outside of the container;

a bottom-up region formed of a curved surface recessed inwardly toward the vicinity of the center axis of the bottle; and a rising region between the bottom face region and the bottom-up region, for continuously and smoothly connecting the curved surface of the bottom face region and the curved surface of the bottom-up region to each other;

wherein the bottom face region and the rising region are bulged toward the underside of the container when the container is filled with the contents, and the bottom face region and the rising region form a flat surface that is closely contacted with a supporting surface of the container.

2. The container according to claim 1, wherein the container is molded from a resin in the amount of about 6 g, when the container has a volume of about 560 ml.

3. The container according to claim 1, wherein the synthetic resin is polypropylene.

4. The container according to claim 1, wherein the bottom face region connects the sidewall to the rising region and is in the shape of a reverse R.

5. The container according to claim 1, wherein the body portion further comprises a reinforcing portion adjacent to the mouth portion.

6. The container according to claim 5, wherein the reinforcing portion is formed in a diamond-cut pattern.

7. The container according to claim 1, wherein the body portion further comprises a gripping recess.

8. The container according to claim 1, wherein the curved surface of the sidewall has a first radius of curvature and the curved surface of the bottom face region has a second radius of curvature, which is less than the first radius of curvature.

* * * * *